US011788550B2

(12) United States Patent
Watanabe

(10) Patent No.: US 11,788,550 B2
(45) Date of Patent: Oct. 17, 2023

(54) BLOWER

(71) Applicant: Makita Corporation, Anjo (JP)

(72) Inventor: Koji Watanabe, Anjo (JP)

(73) Assignee: MAKITA CORPORATION, Anjo (JP)

( * ) Notice: Subject to any disclaimer, the term of this patent is extended or adjusted under 35 U.S.C. 154(b) by 10 days.

(21) Appl. No.: 17/643,098

(22) Filed: Dec. 7, 2021

(65) Prior Publication Data

US 2022/0178383 A1 Jun. 9, 2022

(30) Foreign Application Priority Data

Dec. 8, 2020 (JP) ..... 2020-203682

(51) Int. Cl.
*F04D 29/54* (2006.01)
*F04D 29/66* (2006.01)
*F04D 25/06* (2006.01)

(52) U.S. Cl.
CPC ..... *F04D 29/541* (2013.01); *F04D 25/0673* (2013.01); *F04D 29/664* (2013.01)

(58) Field of Classification Search
CPC ... F04D 25/0673; F04D 29/541; F04D 29/664
See application file for complete search history.

(56) References Cited

U.S. PATENT DOCUMENTS 6,105,206 A 8/2000 Tokumaru et al.
10,337,526 B2 * 7/2019 Shao ..... F04D 29/703
2019/0226498 A1 * 7/2019 Takano ..... F04D 29/4226

FOREIGN PATENT DOCUMENTS

CN 109371888 A * 2/2019 ..... E01H 1/0809
WO WO-2019109278 A1 * 6/2019 ..... A01G 20/47

OTHER PUBLICATIONS

Machine translation of CN 109371888 to Zhou, published Feb. 22, 2019 (Year: 2019).*

* cited by examiner

*Primary Examiner* — Juan G Flores
*Assistant Examiner* — Jason G Davis
(74) *Attorney, Agent, or Firm* — Sughrue Mion, PLLC

(57) ABSTRACT

A blower may include an operation rod extending in a front-rear direction, a rear housing disposed on a rear portion of the operation rod and housing a prime mover, and an attachment detachably attached to a front portion of the operation rod. The attachment may include an air passage pipe housing a fan driven by the prime mover; an intake pipe disposed on a rear portion of the air passage pipe, and a nozzle disposed on a front portion of the air passage pipe. A sound absorbing material may be disposed on an inner surface of the intake pipe.

9 Claims, 10 Drawing Sheets

BLOWER

CROSS-REFERENCE TO RELATED APPLICATION

This application claims priority to Japanese Patent Application No. 2020-203682 filed on Dec. 8, 2020, the contents of which are hereby incorporated by reference into the present application.

TECHNICAL FIELD

Techniques disclosed herein relate to blowers.

BACKGROUND ART

U.S. Pat. No. 6,105,206 describes a blower including an operation rod extending in a front-rear direction, a rear housing disposed on a rear portion of the operation rod and housing a prime mover; and an attachment detachably attached to a front portion of the operation rod. The attachment includes an air passage pipe housing a fan driven by the prime mover, an intake pipe disposed on a rear portion of the air passage pipe, and a nozzle disposed on a front portion of the air passage pipe.

SUMMARY

Generally, it is desirable to reduce noise from a blower. The blower of U.S. Pat. No. 6,105,206 does not consider at all a reduction in noise from the attachment. The disclosure herein provides techniques that enable a reduction in noise from an attachment of a blower.

A blower disclosed herein may comprise: an operation rod extending in a front-rear direction; a rear housing disposed on a rear portion of the operation rod and housing a prime mover; and an attachment detachably attached to a front portion of the operation rod. The attachment may comprise: an air passage pipe housing a fan driven by the prime mover; an intake pipe disposed on a rear portion of the air passage pipe; and a nozzle disposed on a front portion of the air passage pipe. A sound absorbing material may be disposed on an inner surface of the intake pipe.

In the configuration above, the sound absorbing material is disposed on the inner surface of the intake pipe. According to this configuration, the sound absorbing material disposed on the inner surface of the intake pipe absorbs noise caused by air flowing through the intake pipe. Thus, the noise from the attachment of the blower can be reduced.

DETAILED DESCRIPTION

Figure 1:
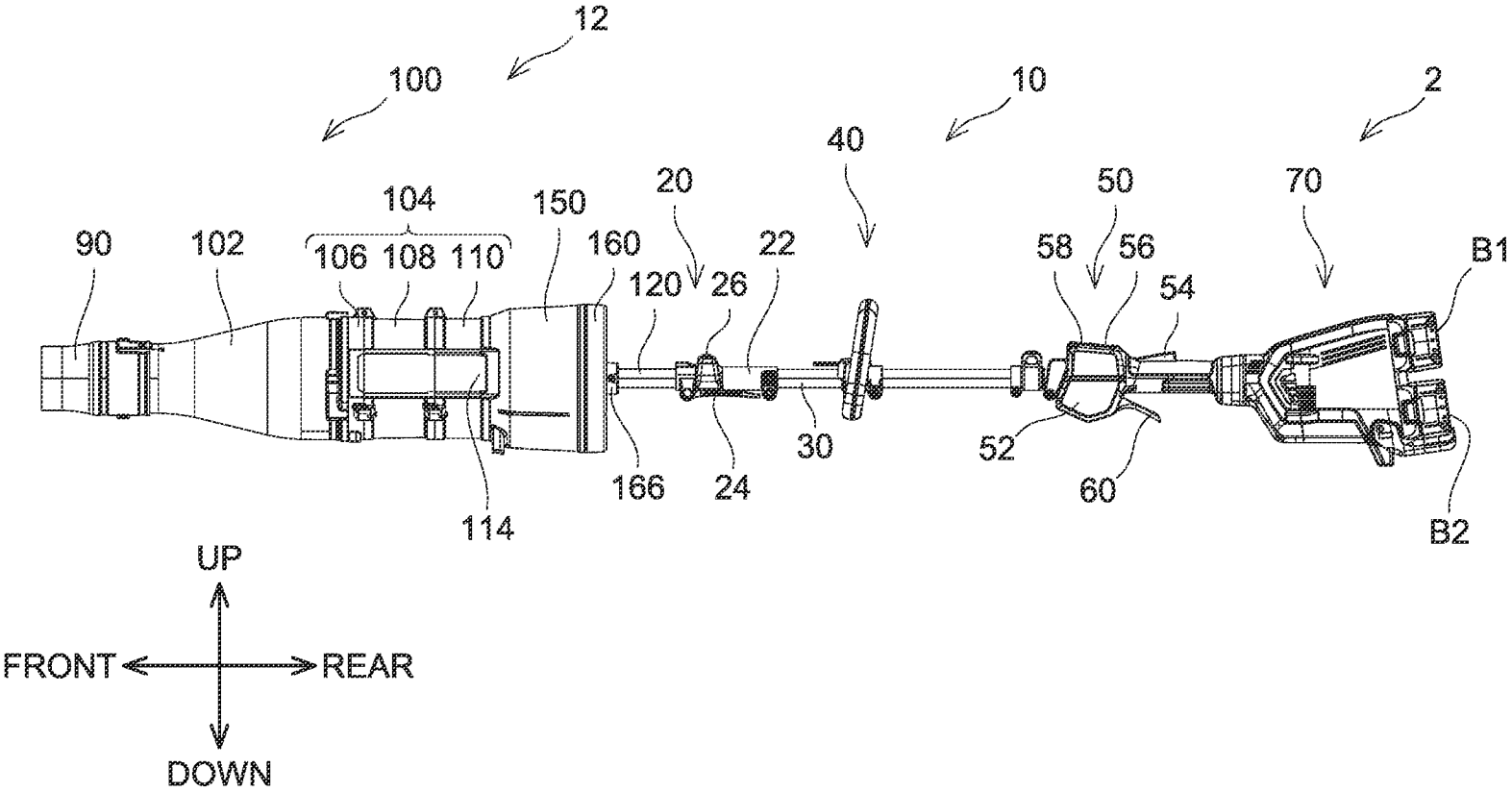
FIG. 1 is a left side view of a blower 2 according to an embodiment.

Representative, non-limiting examples of the present disclosure will now be described in further detail with reference to the attached drawings. This detailed description is merely intended to teach a person of skill in the art further details for practicing aspects of the present teachings and is not intended to limit the scope of the present disclosure. Furthermore, each of the additional features and teachings disclosed below may be utilized separately or in conjunction with other features and teachings to provide improved blowers as well as methods for using and manufacturing the same.

Moreover, combinations of features and steps disclosed in the following detailed description may not be necessary to practice the present disclosure in the broadest sense, and are instead taught merely to particularly describe representative examples of the present disclosure. Furthermore, various features of the above-described and below-described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

In one or more embodiments, a blower may comprise an operation rod extending in a front-rear direction; a rear housing disposed on a rear portion of the operation rod and housing a prime mover; and an attachment detachably attached to a front portion of the operation rod. The attachment may comprise an air passage pipe housing a fan driven by the prime mover; an intake pipe disposed on a rear portion of the air passage pipe; and a nozzle disposed on a front portion of the air passage pipe. A sound absorbing material may be disposed on an inner surface of the intake pipe.

In one or more embodiments, the sound absorbing material may extend along an axial direction of the operation rod on the inner surface of the intake pipe. An axial length of the sound absorbing material along the axial direction may be in a range of 50 mm to 150 mm.

A shorter axial length of the sound absorbing material does not sufficiently provide a noise reduction effect of the sound absorbing material, while a longer axial length of the sound absorbing material requires an axial length of the intake pipe to be increased accordingly, which increases the weight of the attachment and makes it difficult for a user to operate the blower. The sound absorbing material with the axial length in the range of 50 mm to 150 mm can sufficiently provide the noise reduction effect of the sound absorbing material and suppress an increase in the weight of the attachment. Thus, the convenience for the user using the blower can be improved.

In one or more embodiments, a ratio of a diameter of the intake pipe to the axial length of the sound absorbing material may be in a range of 1.0 to 2.0.

According to the configuration above, the sound absorbing material can effectively absorb the noise caused by air flowing through the intake pipe. Thus, the noise from the attachment of the blower can be further reduced.

In one or more embodiments, the intake pipe may be detachably attached to the air passage pipe. A first cover may be attached to a rear portion of the intake pipe. A second cover may be attachable to the rear portion of the air passage pipe instead of the intake pipe.

According to the configuration above, a user who desires to reduce the noise from the attachment of the blower can attach the intake pipe to the rear portion of the air passage pipe, while a user who desires the attachment to be relatively lightweight can attach the second cover to the rear portion of the air passage pipe instead of the intake pipe. Thus, the above configuration allows users to select whether to attach the intake pipe to the rear portion of the air passage pipe or not. Thus, the convenience for the user using the blower can be improved.

In one or more embodiments, the prime mover may be a motor driven by electric power.

If the prime mover is an engine, loud noise is caused by the engine. In this case, the noise from the attachment does not contribute significantly to the overall noise from the blower. On the other hand, if the prime mover is a motor, less noise is caused by the motor. In this case, the noise from the attachment, if it is loud, significantly contributes to the overall noise from the blower. According to the configuration above, the noise from the blower can be reduced when the prime mover is a motor.

In one or more embodiments, the blower may further comprise a battery pack that is detachably attached to the rear housing and is configured to supply electric power to the motor.

According to the configuration above, the blower does not have to include a power cable to take in electric power from the outside. Therefore, there is no possibility that a power cable obstructs the user while he/she is using the blower. Thus, workability for the user using the blower can be improved.

In one or more embodiments, a thickness of the sound absorbing material may be in a range of 10 mm to 25 mm.

A smaller thickness of the sound absorbing material does not sufficiently provide the noise reduction effect of the noise absorbing material, while a larger thickness of the sound absorbing material narrows the passage within the intake pipe, thus reducing an amount of air taken into the intake pipe. The sound absorbing material with the thickness in the range of 10 mm to 25 mm can sufficiently provide the noise reduction effect of the noise absorbing material and allow a moderate amount of air to be taken into the intake pipe.

EMBODIMENTS

Figure 2:
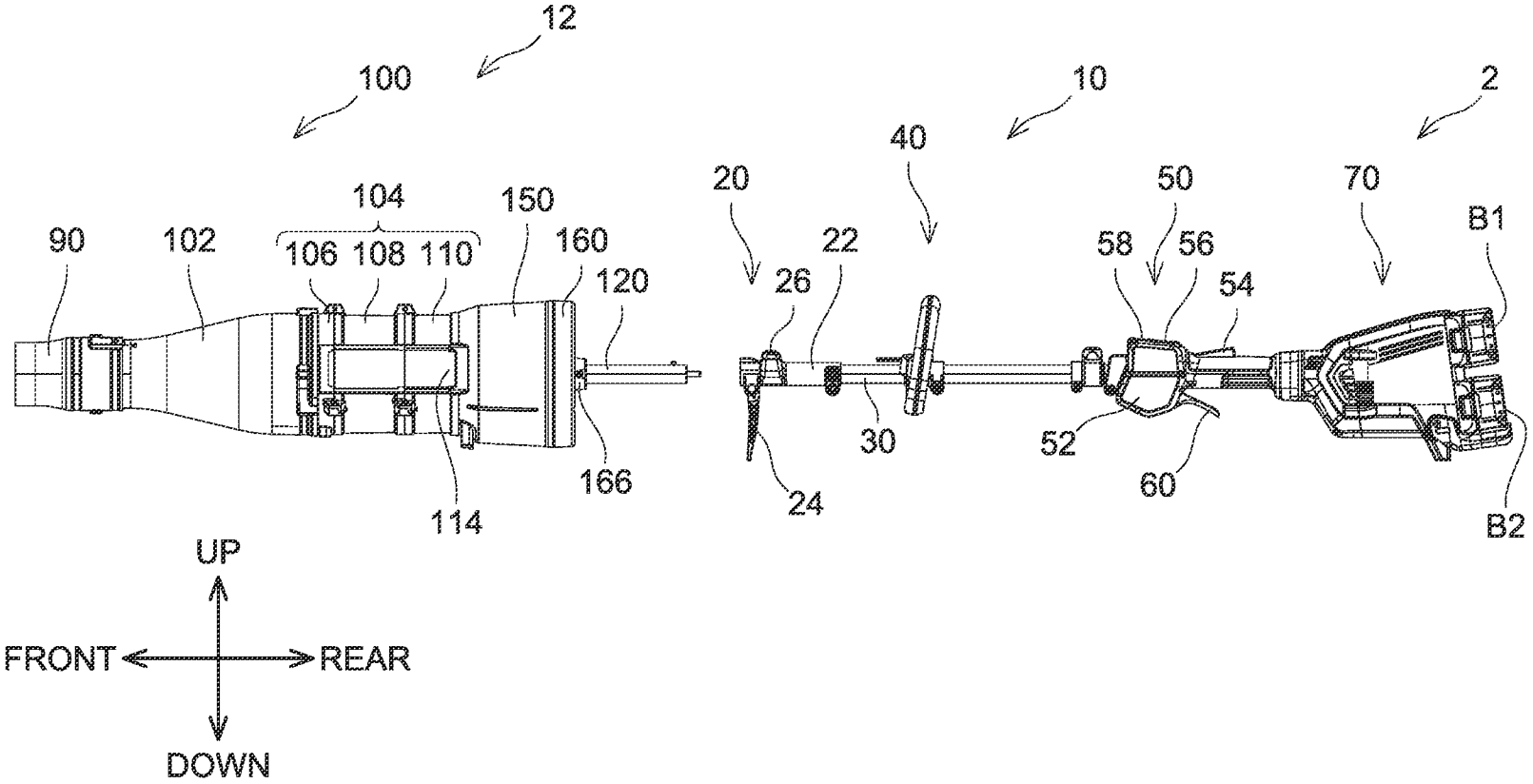
FIG. 2 is an exploded view of the blower 2 according to the embodiment.

Referring to FIGS. 1 to 9, a blower 2 is described. As illustrated in FIG. 1, the blower 2 comprises a main body 10 and an attachment 12. As illustrated in FIGS. 1 and 2, the attachment 12 is detachably attached to the main body 10. An attachment of a different type from the attachment 12, such as an attachment for a trimmer, can be attached to the main body 10.

As illustrated in FIG. 1, the main body 10 comprises a lock unit 20, an operation rod 30, a loop handle 40, a grip unit 50, and a rear housing 70. In the following description, a longitudinal direction of the operation rod 30 is termed a front-rear direction, an up-down direction in FIG. 1 is termed an up-down direction, and a direction perpendicular to the front-rear direction and the up-down direction is termed a right-left direction.

The operation rod 30 is in the form of a hollow pipe and extends linearly. The lock unit 20 is disposed on a front portion of the operation rod 30, and the grip unit 50 and the rear housing 70 are disposed on a rear portion of the operation rod 30. A first transmission shaft 32 (see FIG. 8) is rotatably housed in the operation rod 30. The loop handle 40 which is grippable by a user is disposed between the lock unit 20 and the grip unit 50 on the operation rod 30. The loop handle 40 is in the form of a hollow pipe and has a loop shape that expands upward and laterally from the operation rod 30.

The lock unit 20 comprises a connector 22, a lock lever 24, and an unlock button 26. The operation rod 30 is inserted in the connector 22. The lock lever 24 is pivotably attached to the connector 22. The unlock button 26 is disposed on an upper surface of the connector 22. The user can attach or detach the attachment 12 to/from the operation rod 30 by manipulating the lock lever 24 and the unlock button 26. The attachment 12 is secured to the operation rod 30 by attaching the attachment 12 to the connector 22 with the lock lever 24 raised nearly perpendicular to the operation rod 30 (see FIG. 2) and then pushing the lock lever 24 down to be nearly parallel to the operation rod 30 (see FIG. 1).

The grip unit 50 comprises a grip housing 52. The grip housing 52 is constituted of a resin material and is formed in a shape that covers an outer surface of the operation rod 30. The operation rod 30 extends through the grip housing 52. A lever 54 is disposed on an upper surface of the grip housing 52. On the upper surface of the grip housing 52, an operation part 56 and a display 58 are disposed forward of the lever 54. An operation state of the blower 2, etc. is displayed on the display 58. A power switch for switching the operation state of the blower 2 between an on-state and an off-state is disposed at the operation part 56. A trigger 60 is disposed at a lower portion of the grip housing 52. The trigger 60 is a member that is operated by the user to switch the operation of a motor 72 (see FIG. 9) between an on-operation and an off-operation. When the lever 54 is not pushed in by the user, a push-in operation on the trigger 60 by the user is prohibited. To the contrary, when the lever 54 is pushed in by the user, the push-in operation on the trigger 60 by the operator is permitted. The user can perform an operation for driving the motor 72 (which will be described later, see FIG. 9) by pushing in the lever 54 with one hand and pushing in the trigger 60 with the fingers of the hand.

Two battery packs B1, B2 are detachably attached to a rear portion of the rear housing 70. The rear housing 70 houses the motor 72 (see FIG. 9) and a control board 74 (see FIG. 9) that controls the driving of the motor 72. The control board 74 controls the operation of the motor 72 by controlling electric power supplied from the battery packs B1, B2 to the motor 72.

Figure 3:
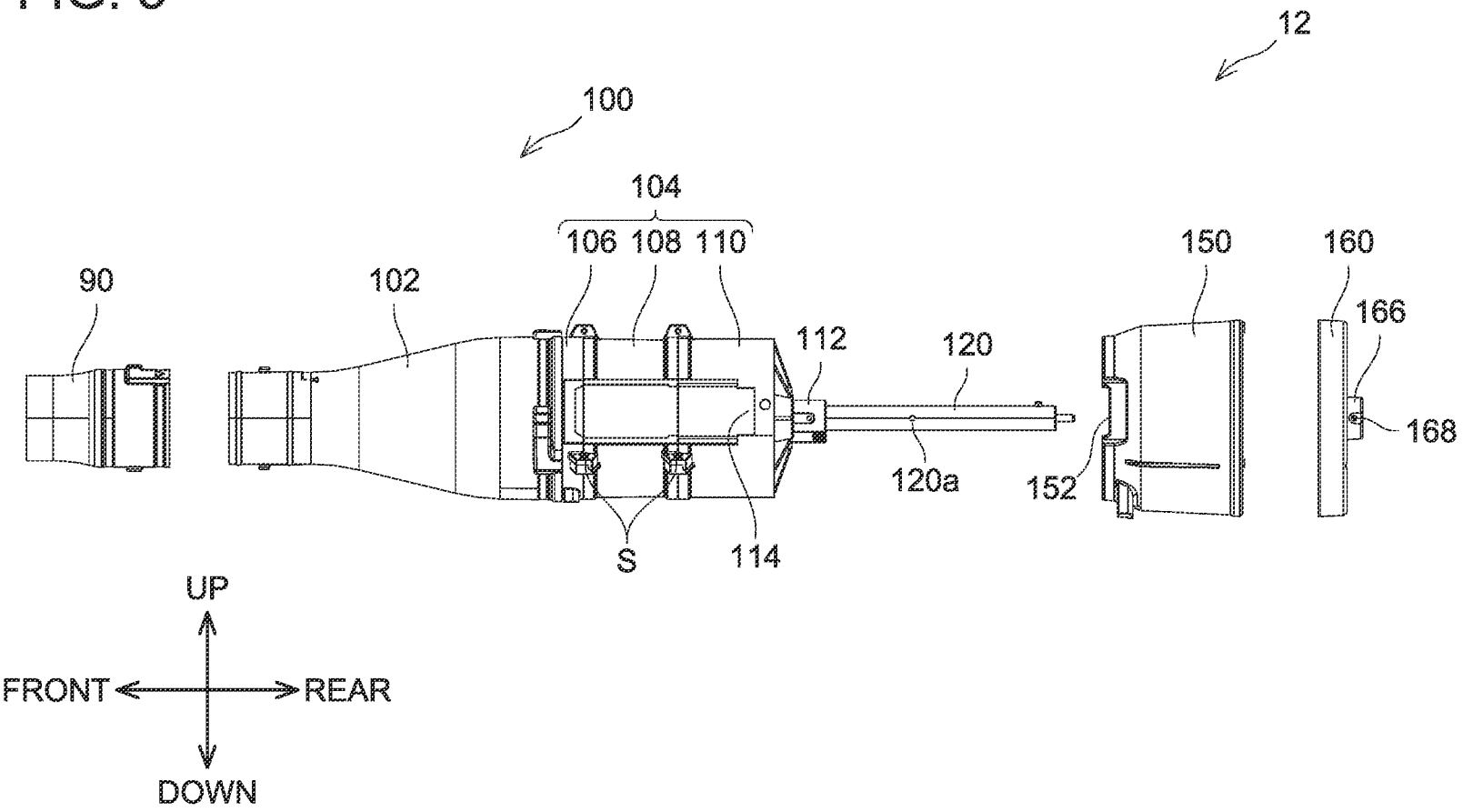
FIG. 3 is an exploded view of an attachment 12 according to the embodiment.
Figure 10:
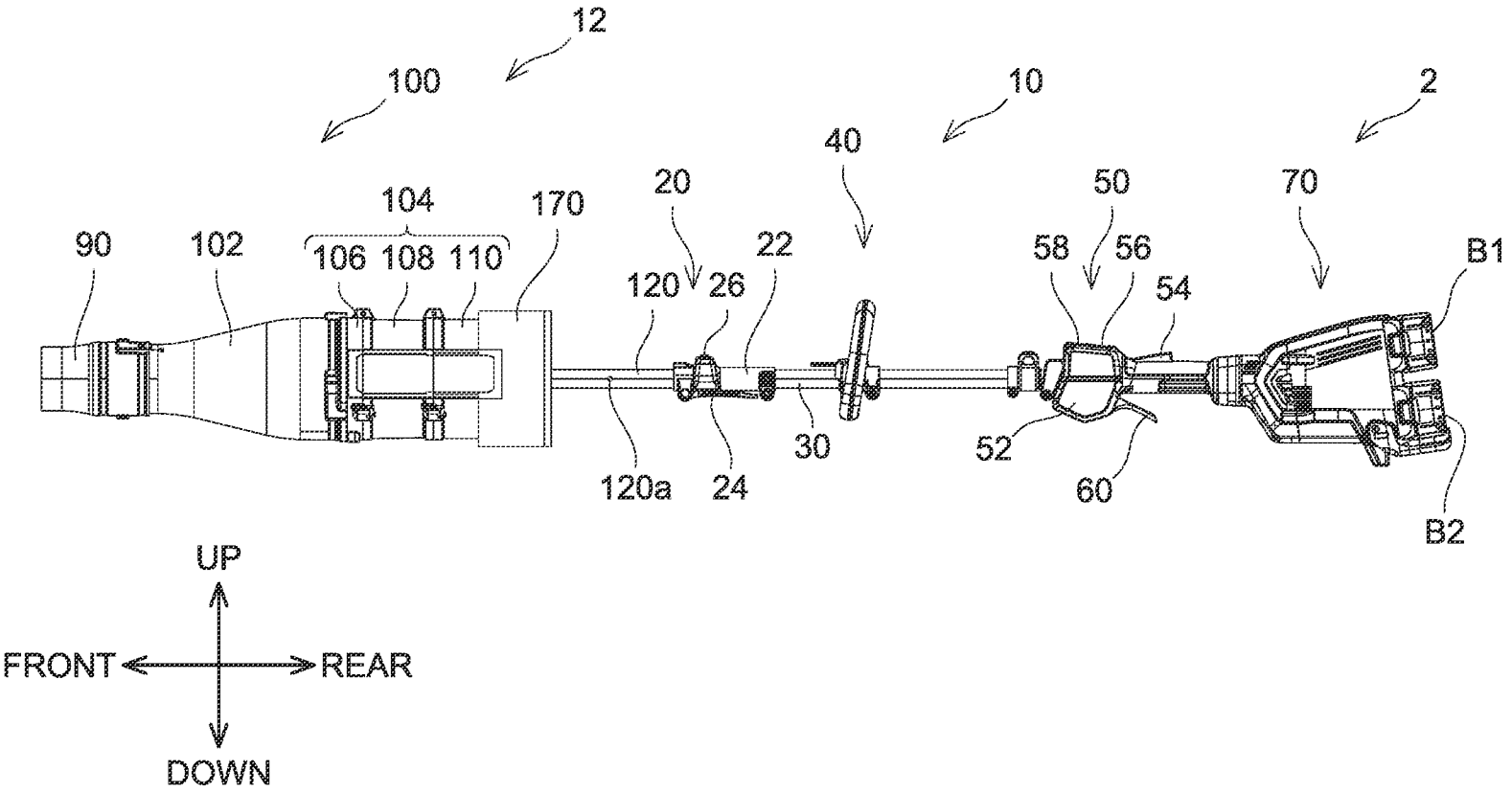
FIG. 10 is a left side view of the blower 2 according to the embodiment with a second cover 170 attached thereto.

As illustrated in FIG. 3, the attachment 12 comprises a nozzle 90, an air passage pipe 100, an intake pipe 150, and a first cover 160. The nozzle 90 is detachably attached to a front portion of the air passage pipe 100. The intake pipe 150 and the first cover 160 are detachably attached to a rear portion of the air passage pipe 100. The rear portion of the air passage pipe 100 is configured such that a second cover 170 (see FIG. 10) is attachable thereto instead of the intake pipe 150. The first cover 160 and the second cover 170 prevent an entry of a hand of the user into the attachment 12.

Figure 4:
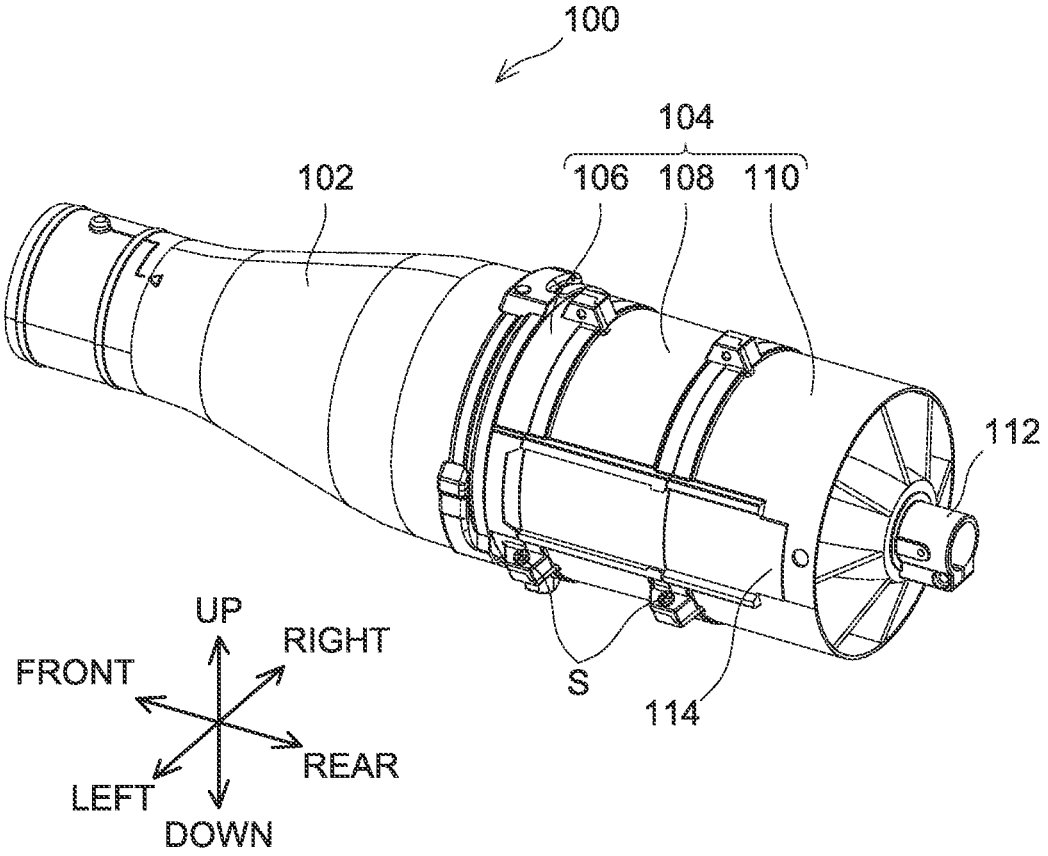
FIG. 4 is a perspective view of an air passage pipe 100 according to the embodiment, as viewed from the rear left side.

The air passage pipe 100 comprises an adapter 102, a cylindrical pipe 104, and a connector rod 120. The cylindrical pipe 104 comprises a front cylindrical pipe 106, a middle cylindrical pipe 108, and a rear cylindrical pipe 110. The front cylindrical pipe 106 is secured to the middle cylindrical pipe 108 with a screw S. The middle cylindrical pipe 108 is secured to the rear cylindrical pipe 110 with another screw S. A connector rod holder 112 is disposed at a rear portion of the rear cylindrical pipe 110. As illustrated in FIG. 4, projections 114 that project radially outward from the rear cylindrical pipe 110 are disposed on the rear cylindrical pipe 110. The projections 114 extend in the front-rear direction.

Figure 8:
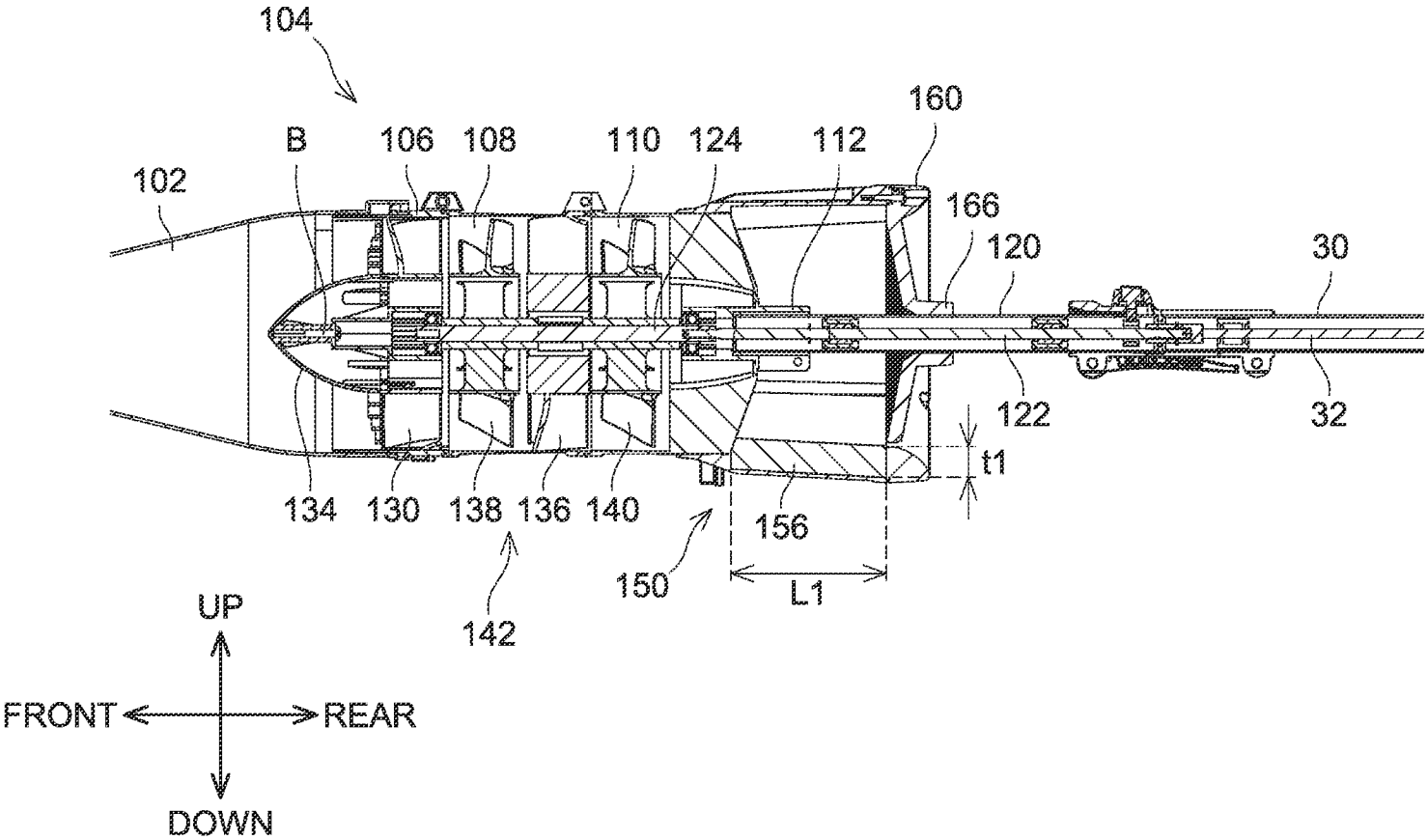
FIG. 8 is a cross-sectional view of the blower 2 according to the embodiment, as viewed from the left side.
Figure 9:
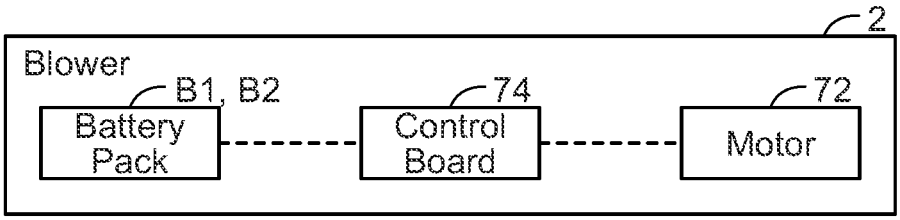
FIG. 9 is a diagram illustrating an electrical configuration of the blower 2 according to the embodiment.

As illustrated in FIG. 8, the connector rod 120 is in the form of a hollow pipe and extends linearly. As illustrated in FIG. 3, a screw hole 120*a* is provided in the connector rod 120. A front portion of the connector rod 120 is inserted in the connector rod holder 112 of the rear cylindrical pipe 110. As illustrated in FIG. 8, a second transmission shaft 122 is rotatably housed in the connector rod 120. A rear portion of the second transmission shaft 122 is attached to the first transmission shaft 32 in the operation rod 30. A front portion of the second transmission shaft 122 is attached to a third transmission shaft 124 housed in the cylindrical pipe 104.

The front cylindrical pipe 106 comprises a front stator vane 130. A fan cover 134 is attached to a front portion of the front cylindrical pipe 106. Further, the third transmission shaft 124 is rotatably attached to the front cylindrical pipe 106. The middle cylindrical pipe 108 comprises a rear stator vane 136. Within the cylindrical pipe 104, a front rotor vane 138 is disposed between the front stator vane 130 and the rear stator vane 136. A rear rotor vane 140 is disposed rearward of the rear stator vane 136. The front rotor vane 138 and the rear rotor vane 140 are secured to the third transmission shaft 124. The front stator vane 130, the rear stator vane 136, the front rotor vane 138, and the rear rotor vane 140 configure a fan 142.

Figure 5:
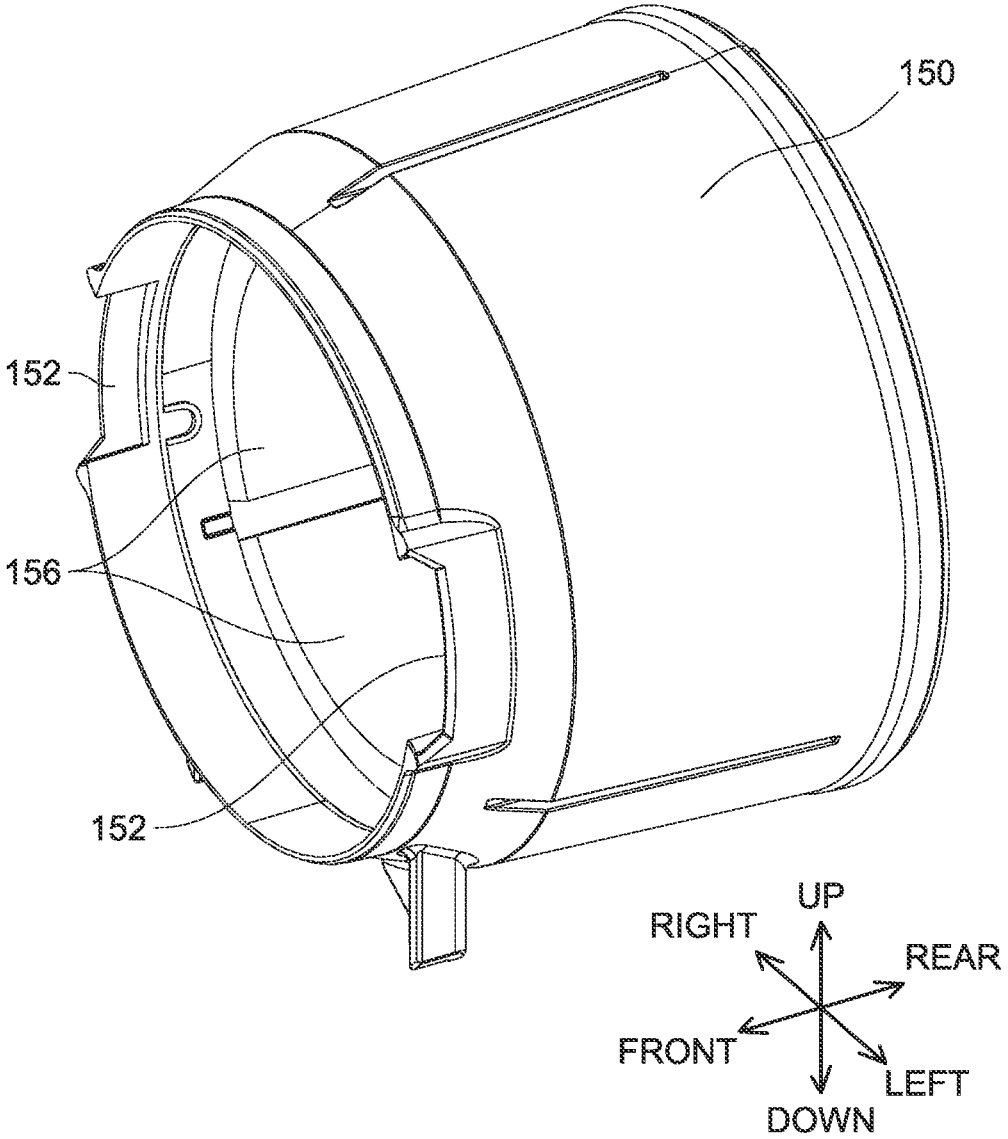
FIG. 5 is a perspective view of an intake pipe 150 according to the embodiment, as viewed from the front left side.
Figure 6:
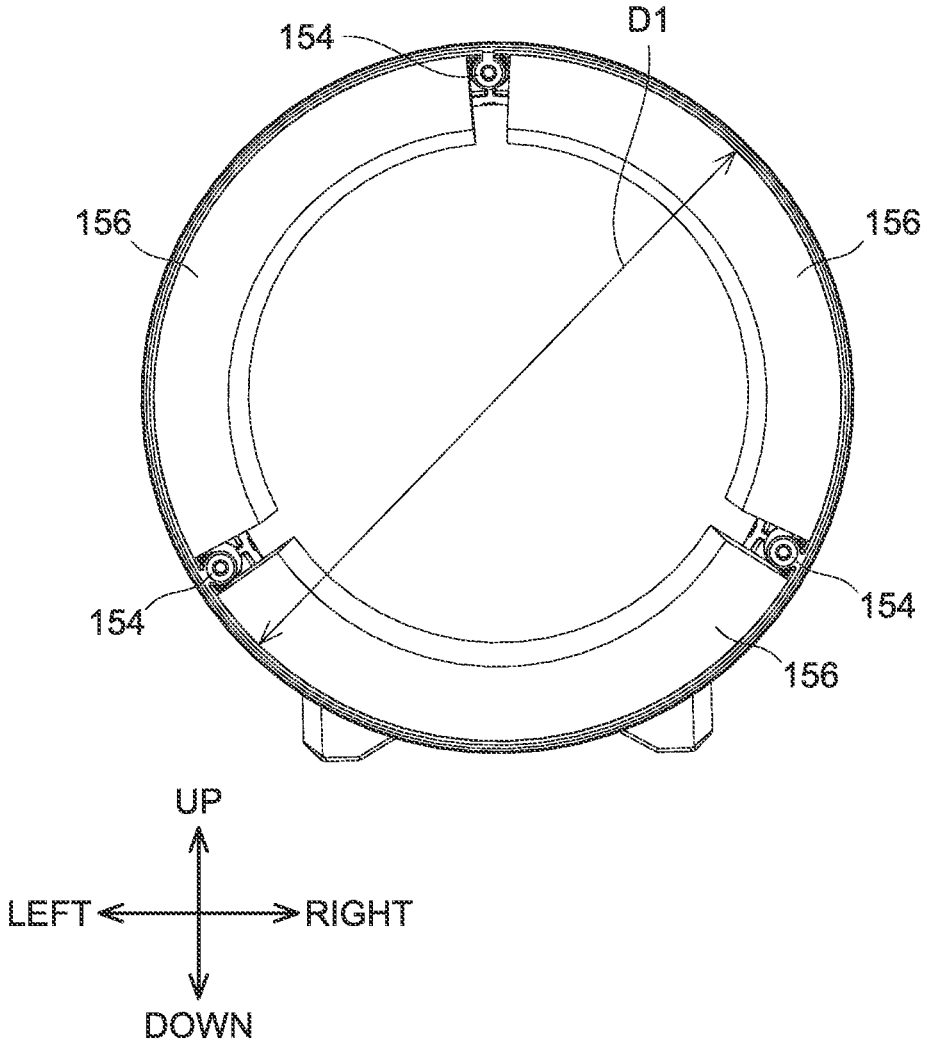
FIG. 6 is a rear view of the intake pipe 150 according to the embodiment.

The intake pipe 150 is tubular. Outer and inner surfaces of the intake pipe 150 are inclined such that their front portions are positioned closer to the central axis of the operation rod 30. As illustrated in FIG. 5, two slide grooves 152 are provided in left and right sides of a front portion of the intake pipe 150, respectively. The slide grooves 152 have a shape corresponding to the shape of the projections 114 of the rear cylindrical pipe 110 (see FIG. 4). Rotation of the intake pipe 150 relative to the air passage pipe 100 is restricted by the projections 114 being fitted in the slide grooves 152. As illustrated in FIG. 6, three bosses 154 are disposed at the rear portion of the intake pipe 150. A sound absorbing material 156 is disposed on the inner surface of the intake pipe 150. The sound absorbing material 156 is bonded to the inner surface of the intake pipe 150 via an adhesive. The sound absorbing material 156 is a sponge and a surface of the sponge is coated with a film. Forming a film on the surface of the sponge improves a noise reduction effect of the sound absorbing material 156 as compared to a configuration in which the surface of the sponge is not coated with a film. A rearmost diameter D1 of the intake pipe 150 is, for example, 180 mm. As illustrated in FIG. 8, a thickness t1 of the sound absorbing material 156 is constant in the front-rear direction. The thickness t1 of the sound absorbing material 156 is, for example, in a range of 10 mm to 25 mm, and the thickness of the coating film is, for example, equal to or less than 100 μm. A length L1 of the sound absorbing material 156 in the front-rear direction is, for example, 100 mm. A ratio of the diameter D1 of the intake pipe 150 to the length L1 of the sound absorbing material 156 is, for example, 1.8.

Figure 7:
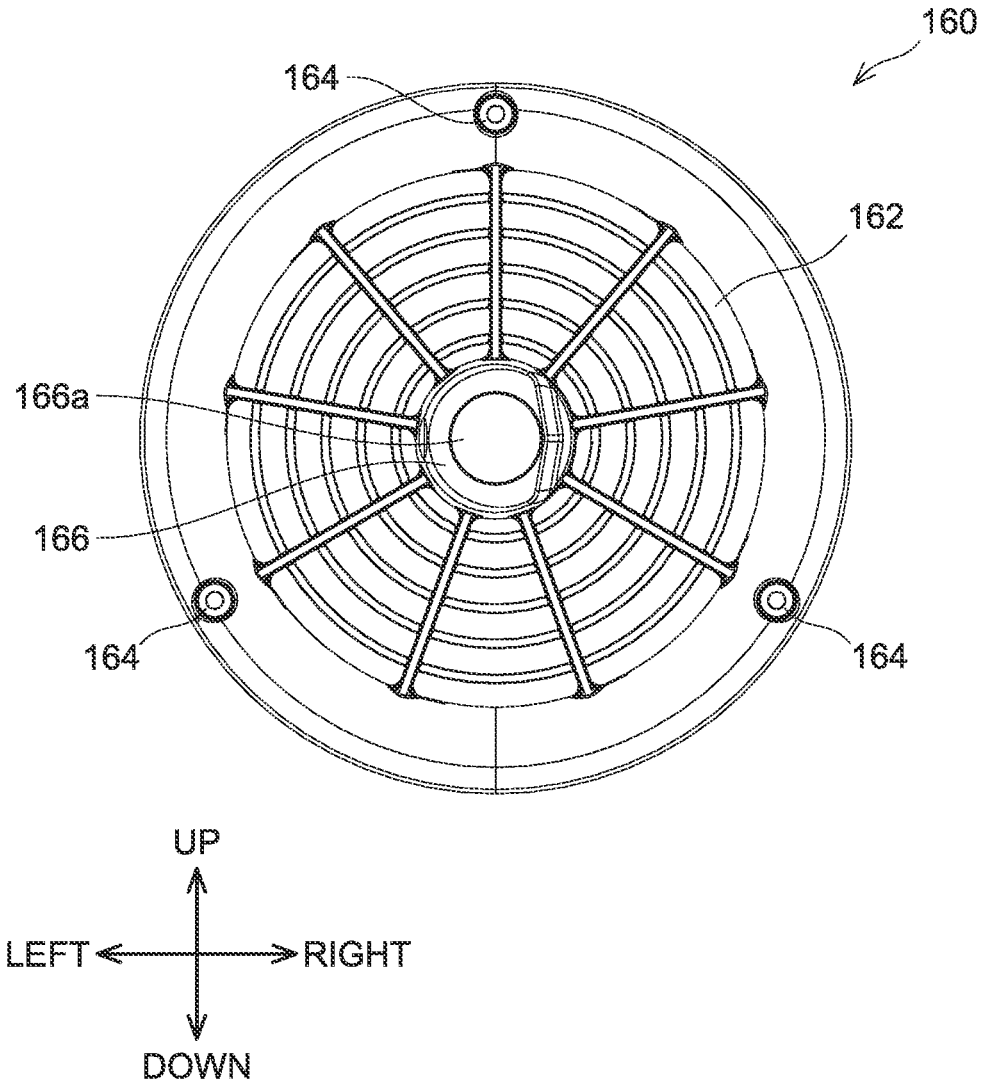
FIG. 7 is a rear view of a first cover 160 according to the embodiment.

As illustrated in FIG. 7, the first cover 160 comprises an intake hole 162, three screw holes 164 disposed outward of the intake hole 162, and a connector rod holder 166 disposed inward of the intake hole 162. The three screw holes 164 are positioned corresponding to the three bosses 154 of the intake pipe 150 (see FIG. 6). The connector rod holder 166 includes a through hole 166*a* that extends through the connector rod holder 166 in the front-rear direction. As illustrated in FIG. 3, the connector rod holder 166 includes a screw hole 168. The screw hole 168 is positioned corresponding to the screw hole 120*a* of the connector rod 120.

Hereinafter, how the intake pipe 150 and the first cover 160 are attached to the air passage pipe 100 is described. Firstly, as illustrated in FIG. 3, the projections 114 of the air passage pipe 100 are aligned with the slide grooves 152 of the intake pipe 150, and then the intake pipe 150 is moved forward to the air passage pipe 100. The projections 114 are thereby fitted in the slide grooves 152. Then, the three bosses 154 of the intake pipe 150 (see FIG. 6) and the three screw holes 164 of the first cover 160 (see FIG. 7) are screwed together, thereby securing the first cover 160 to the intake pipe 150. The screw hole 168 of the first cover 160 (see FIG. 3) and the screw hole 120*a* of the connector rod 120 (see FIG. 3) are then screwed together, thereby securing the first cover 160 to the connector rod 120. Thus, the intake pipe 150 and the first cover 160 are secured to the air passage pipe 100. By performing the above procedure in the reverse order, the intake pipe 150 and the first cover 160 can be detached from the air passage pipe 100.

As described above and illustrated in FIGS. 1 to 9, the blower 2 according to an embodiment comprises the operation rod 30 extending in the front-rear direction, the rear housing 70 disposed on the rear portion of the operation rod 30 and housing the motor 72, and the attachment 12 detachably attached to the front portion of the operation rod 30. The attachment 12 comprises the air passage pipe 100 housing the fan 142 driven by the motor 72, the intake pipe 150 disposed on the rear portion of the air passage pipe 100, and the nozzle 90 disposed on the front portion of the air passage pipe 100. The sound absorbing material 156 is disposed on the inner surface of the intake pipe 150. According to this configuration, the sound absorbing material 156 disposed on the inner surface of the intake pipe 150 absorbs the noise caused by air flowing through the intake pipe 150. Thus, the noise from the attachment 12 of the blower 2 can be reduced.

In one embodiment, the sound absorbing material 156 extends along an axial direction of the operation rod 30 on the inner surface of the intake pipe 150 as illustrated in FIG. 8, and an axial length of the sound absorbing material 156 along the axial direction is in a range of 50 mm to 150 mm. A shorter axial length of the sound absorbing material 156 does not sufficiently provide the noise reduction effect of the sound absorbing material 156, while a longer axial length of the sound absorbing material 156 requires the axial length of the intake pipe 150 to be increased accordingly, which increases the weight of the attachment 12 and makes it difficult for the user to operate the blower 2. The sound absorbing material 156 with the axial length in the range of 50 mm to 150 mm can sufficiently provide the noise reduction effect of the sound absorbing material 156 and suppress an increase in the weight of the attachment 12. Thus, the convenience for the user using the blower 2 can be improved.

In the blower 2 according to one embodiment, the ratio of the diameter D1 of the intake pipe 150 to the axial length L1 (in this embodiment, the length in the front-rear direction) of the sound absorbing material 156 is in a range of 1.0 to 2.0, as illustrated in FIGS. 6 and 8. According to this configuration, the sound absorbing material 156 can effectively absorb the noise caused by air flowing through the intake pipe 150. Thus, the noise from the attachment 12 of the blower 2 can be further reduced.

In one embodiment, the intake pipe 150 is detachably attached to the air passage pipe 100, and the first cover 160 is attached to the rear portion of the intake pipe 150, as illustrated in FIG. 3. The second cover 170 is attachable to the rear portion of the air passage pipe 100 instead of the intake pipe 150. According to this configuration, a user who desires to reduce the noise from the attachment 12 of the blower 2 can attach the intake pipe 150 to the rear portion of the air passage pipe 100, while a user who desires the attachment 12 to be relatively lightweight can attach the second cover 170 to the rear portion of the air passage pipe 100 instead of the intake pipe 150. Thus, the configuration allows users to select whether to attach the intake pipe 150 to the rear portion of the air passage pipe 100 or not. Thus, the convenience for the user using the blower 2 can be improved.

In the blower 2 according to one embodiment, its prime mover is the motor 72 driven by electric power. If the prime mover is an engine, loud noise is caused by the engine. In this case, the noise from the attachment 12 does not contribute significantly to the overall noise from the blower 2. On the other hand, if the prime mover is the motor 72, less noise is caused by the motor 72. In this case, the noise from the attachment 12, if it is loud, significantly contributes to the overall noise from the blower 2. According to the configuration above, the noise from the blower 2 can be reduced when the prime mover is the motor 72.

In one embodiment, the blower 2 comprises the battery packs B1, B2 that are detachably attached to the rear housing 70 and are configured to supply electric power to the motor 72, as illustrated in FIG. 1. According to this configuration, the blower 2 does not have to include a power cable to take in electric power from the outside. Therefore, there is no possibility that a power cable obstructs the user while he/she is using the blower 2. Thus, workability for the user using the blower 2 can be improved.

In the blower 2 according to one embodiment, the thickness t1 of the sound absorbing material 156 is in a range of 10 mm to 25 mm, as illustrated in FIG. 8. A smaller thickness of the sound absorbing material 156 does not sufficiently provide the noise reduction effect of the sound absorbing material 156, while a larger thickness of the sound absorbing material 156 narrows the passage in the intake pipe 150, thus reducing an amount of air taken into the intake pipe 150. The sound absorbing material 156 with the thickness in the range of 10 mm to 25 mm can sufficiently provide the noise reduction effect of the sound absorbing material 156 and allow a moderate amount of air to be taken into the intake pipe 150.

(First Variant) The axial length of the sound absorbing material 156 may be less than 50 mm or greater than 150 mm.

(Second Variant) The ratio of the diameter D1 of the intake pipe 150 to the axial length L1 of the sound absorbing material 156 may be less than 1.0 or greater than 2.0.

(Third Variant) The surface of the sound absorbing material 156 may not be coated with a film. This configuration can reduce resistance against air flowing through the intake pipe 150 as compared to the configuration in which the surface of the sound absorbing material 156 is coated with a film.

(Fourth Variant) The intake pipe 150 may be integral with the air passage pipe 100.

(Fifth Variant) The "prime mover" is not limited to the motor 72 and may be an engine.

(Sixth Variant) The blower 2 may not comprise the battery packs B1, B2. In this variant, the blower 2 may be connectable to an external power via a power cable.

(Seventh Variant) The thickness t1 of the sound absorbing material 156 may be less than 10 mm or greater than 25 mm.

What is claimed is:

1. A blower comprising:

an operation rod that is stationary and extends in a front-rear direction;

a rear housing disposed on a rear portion of the operation rod and housing a prime mover; and an attachment detachably attached to a front portion of the operation rod, wherein the attachment comprises:

an air passage pipe housing a fan driven by the prime mover;

an intake pipe disposed on a rear portion of the air passage pipe; and a nozzle disposed on a front portion of the air passage pipe, and a sound absorbing material is disposed on an inner surface of the intake pipe.

2. The blower according to claim 1, wherein the sound absorbing material extends along an axial direction of the operation rod on the inner surface of the intake pipe, and an axial length of the sound absorbing material along the axial direction is in a range of 50 mm to 150 mm.

3. The blower according to claim 2, wherein a ratio of a diameter of the intake pipe to the axial length of the sound absorbing material is in a range of 1.0 to 2.0.

4. The blower according to claim 1, wherein the prime mover is a motor driven by electric power.

5. The blower according to claim 4, further comprising a battery pack that is detachably attached to the rear housing and is configured to supply electric power to the motor.

6. The blower according to claim 1, wherein a thickness of the sound absorbing material is in a range of 10 mm to 25 mm.

7. The blower according to claim 1, further comprising a handle directly attached to the operation rod and wherein the handle is configured to be gripped by a user.

8. A blower comprising:

an operation rod extending in a front-rear direction;

a rear housing disposed on a rear portion of the operation rod and housing a prime mover; and an attachment detachably attached to a front portion of the operation rod, wherein the attachment comprises:

an air passage pipe housing a fan driven by the prime mover;

an intake pipe disposed on a rear portion of the air passage pipe; and a nozzle disposed on a front portion of the air passage pipe, and a sound absorbing material is disposed on an inner surface of the intake pipe, the sound absorbing material extends along an axial direction of the operation rod on the inner surface of the intake pipe, an axial length of the sound absorbing material along the axial direction is in a range of 50 mm to 150 mm, a ratio of a diameter of the intake pipe to the axial length of the sound absorbing material is in a range of 1.0 to 2.0, the prime mover is a motor driven by electric power, the blower further comprising:

a battery pack that is detachably attached to the rear housing and is configured to supply electric power to the motor, and a thickness of the sound absorbing material is in a range of 10 mm to 25 mm.

9. A blower comprising:

an operation rod extending in a front-rear direction;

a rear housing disposed on a rear portion of the operation rod and housing a prime mover; and an attachment detachably attached to a front portion of the operation rod, wherein the attachment comprises:

an air passage pipe housing a fan driven by the prime mover;

an intake pipe disposed on a rear portion of the air passage pipe; and a nozzle disposed on a front portion of the air passage pipe, and a sound absorbing material is disposed on an inner surface of the intake pipe, wherein the sound absorbing material extends along an axial direction of the operation rod on the inner surface of the intake pipe, and an axial length of the sound absorbing material along the axial direction is in a range of 50 mm to 150 mm, wherein a ratio of a diameter of the intake pipe to the axial length of the sound absorbing material is in a range of 1.0 to 2.0.

* * * * *